US009580968B2

(12) United States Patent
Liu et al.

(10) Patent No.: US 9,580,968 B2
(45) Date of Patent: Feb. 28, 2017

(54) ROTARY STEERABLE DRILLING TOOL WITH ELECTROMAGNETIC STEERING SYSTEM

(71) Applicants: Ce Liu, Houston, TX (US); Treston Davis, Houston, TX (US); Ricki Marshall, Houston, TX (US); Jing Li, Houston, TX (US)

(72) Inventors: Ce Liu, Houston, TX (US); Treston Davis, Houston, TX (US); Ricki Marshall, Houston, TX (US); Jing Li, Houston, TX (US)

(73) Assignee: Bitswave, Inc., Sauger Land, TX (US)

( * ) Notice: Subject to any disclaimer, the term of this patent is extended or adjusted under 35 U.S.C. 154(b) by 316 days.

(21) Appl. No.: 14/308,458

(22) Filed: Jun. 18, 2014

(65) Prior Publication Data

US 2015/0368974 A1 Dec. 24, 2015

Related U.S. Application Data

(60) Provisional application No. 61/836,616, filed on Jun. 18, 2013.

(51) Int. Cl.
*E21B 7/24* (2006.01)
*E21B 7/06* (2006.01)

(52) U.S. Cl.
CPC ..... *E21B 7/24* (2013.01); *E21B 7/067* (2013.01)

(58) Field of Classification Search
CPC ... E21B 7/24; E21B 7/067; E21B 4/04; E21B 4/003; E21B 7/04
See application file for complete search history.

(56) References Cited

U.S. PATENT DOCUMENTS 6,092,610 A * 7/2000 Kosmala ..... E21B 4/20 175/27
6,427,783 B2 * 8/2002 Krueger ..... 175/325.3
2002/0175003 A1 * 11/2002 Pisoni ..... E21B 7/067 175/74
2014/0326509 A1 * 11/2014 Hay ..... E21B 17/003 175/57
2014/0345944 A1 * 11/2014 Liu ..... E21B 17/028 175/40

* cited by examiner

*Primary Examiner* — Yong-Suk (Philip) Ro
(74) *Attorney, Agent, or Firm* — Lai, Corsini, & Lapus, LLC; Thoedore Lapus

(57) ABSTRACT

A rotary steerable drilling tool with an electromagnetic steering system can include a drill collar, a bit shaft, an orientation control module, a mud tube, a mud tube coupler, a universal joint, a mud sealing device, and a drill bit. The bit shaft can be mechanically coupled to the drill collar through the universal joint and the orientation control module and rotate about the universal joint. The orientation and the inclination angle of the bit shaft against the drill collar can be controlled by the orientation control module with the electromagnetic steering system. The orientation control module can include an array of electromagnets, an array of permanent magnets, a rotor, and a set of bearings. The orientation control module can be coupled to the bit shaft through the rotor. The movement of the rotor can be driven by the interaction between the array of electromagnets and the array of permanent magnets.

8 Claims, 9 Drawing Sheets

ROTARY STEERABLE DRILLING TOOL WITH ELECTROMAGNETIC STEERING SYSTEM

FIELD

The present invention relates generally to apparatuses and methods for the directional drilling of wells, particularly wells for the production of oil and gas. More specifically, the present invention relates to a rotary steerable drilling tool with an electromagnetic steering system.

BACKGROUND

There are mainly two well-known types of systems for directional drilling of wells: 1) push-the-bit system; and 2) point-the-bit system. The push-the-bit system controls the well drilling direction by pushing the sidewall of the well at the opposite side against the designated drilling direction, as described in the U.S. Pat. No. 6,427,783 issued to Volker Krueger on Aug. 6, 2002 and the U.S. Pat. No. 6,206,108 issued to MacDonald et al on Mar. 27, 2001. The point-the-bit system directly points the drill bit at the planned drilling direction, as described in the U.S. Pat. No. 6,092,610 issued to Alexandre G. E. Kosmala et al. on Jul. 25, 2000 and the U.S. Pat. App. No. 2002/0175003 published on Nov. 28, 2002 by Attilio C. Pisoni et al.

A point-the-bit system usually comprises of at least one bit shaft within the drilling collar. The bit shaft can be supported by a universal joint within the drilling collar and is rotatably driven by the drilling collar. For directional drilling purpose, the bit shaft must be maintained geostationary and axially inclined to the drilling collar during the drilling collar rotation. The point-the-bit system usually also incorporates a directional control method that the drill bit can be offset in the desired direction as the drilling tool rotates. However, the point-the-bit system requires complicated mechanical designs.

Therefore, a need exists for a rotary steerable drilling tool with simpler structure design.

A further need exists for a rotary steerable drilling tool with electromagnetic steering system to control the drilling direction.

The present embodiments of the present invention meet these needs and improve on the technology.

BRIEF DESCRIPTION OF THE DRAWINGS

The drawings described herein are for illustrating purposes only of selected embodiments and not all possible implementation and are not intended to limit the scope of the present disclosure.

The detailed description will be better understood in conjunction with the accompanying drawings as follows.

The present embodiments are detailed below with reference to the listed Figures.

DETAILED DESCRIPTION OF THE EMBODIMENTS

Before explaining the present apparatus in detail, it is to be understood that the present invention is not limited to the particular embodiments and that it can be practiced or carried out in various ways.

The present invention relates generally to apparatuses and methods for the directional drilling of wells, particularly wells for the production of petroleum products. More specifically, the present invention relates to a rotary steerable drilling tool with an electromagnetic steering system.

Figure 1:
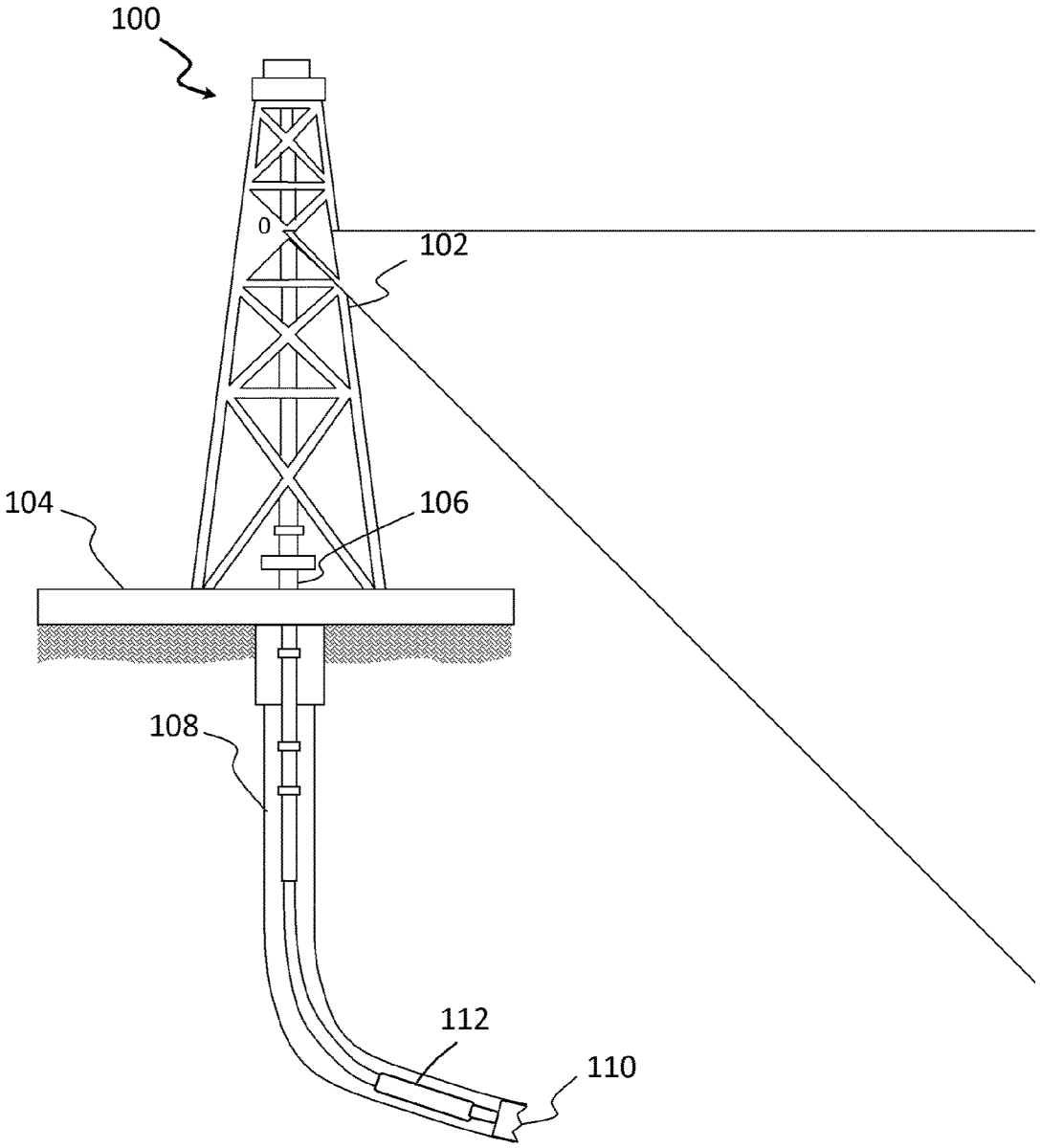
FIG. 1 illustrates a front view of a rotary steerable drilling system assembled with a conventional logging while drilling system.

FIG. 1 illustrates a front view of a rotary steerable drilling system 112 assembled with a conventional logging while drilling system 100 according to some embodiments of the present invention. The conventional logging while drilling system 100 can include a drilling rig 102, a drill string 106, a drilling bit 110, and a rotary steerable drilling system 112. The drill string 106 supported by the drilling rig 102 can extend from above a surface 104 down into a borehole 108. The drill string 106 can carry on the drilling bit 110 and the rotary steerable drilling system 112 to make directional drilling of wells.

Figure 2:
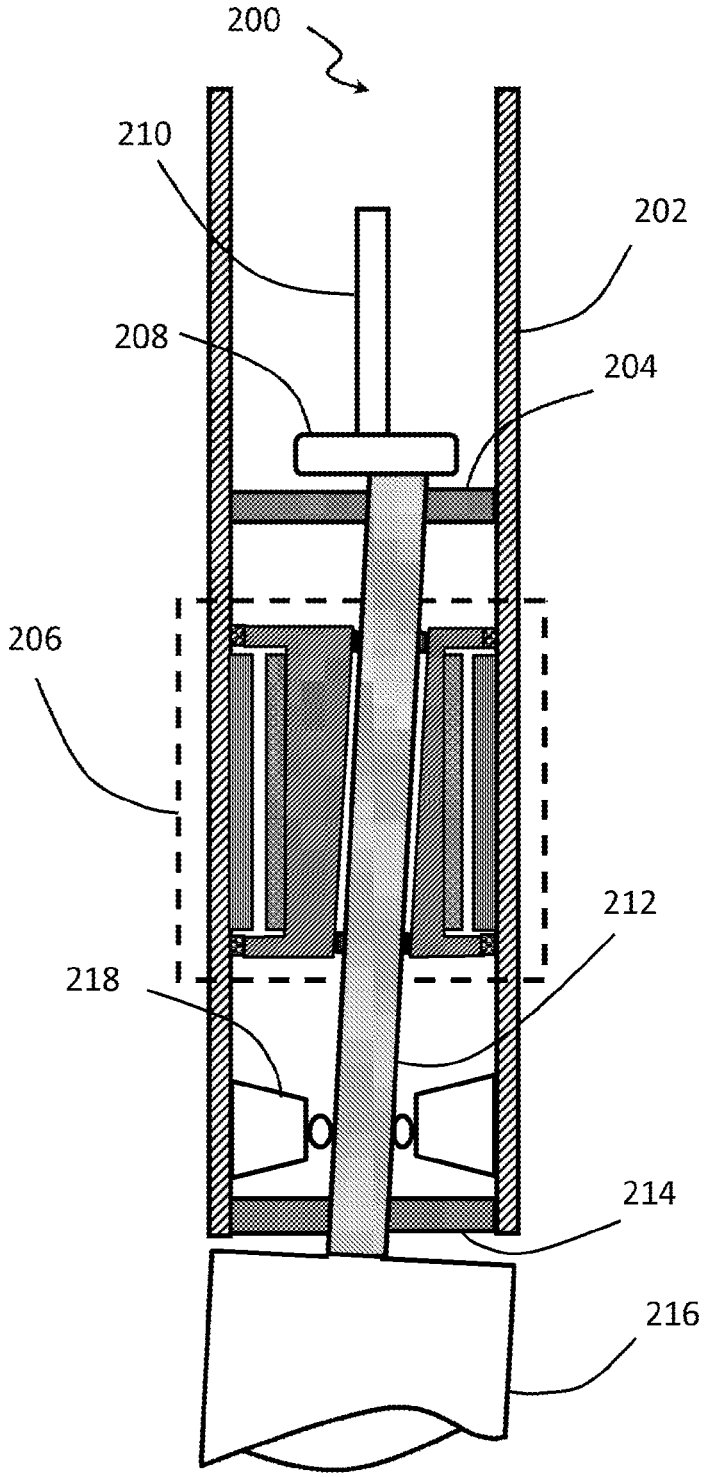
FIG. 2 illustrates a perspective view of a rotary steerable drilling tool with an electromagnetic steering system.

FIG. 2 illustrates a perspective view of a rotary steerable drilling tool 200 with an electromagnetic steering system according to some embodiments of the present invention. The rotary steerable drilling tool 200 can include a drill collar 202, a bit shaft 212, an orientation control module 206, a mud tube 210, a mud tube coupler 208, a universal joint 218, mud sealing devices 204 and 214, and a drill bit 216. The bit shaft 212 can be mechanically coupled to the drill collar 202 through the universal joint 218 and the orientation control module 206. The bit shaft 212 can rotate about the universal joint 218, which can be acted as a pivot. The weight of the entire drill string and the rotation torque of the drill collar 202 can be transmitted onto the drill bit 216 via the universal joint 218. The orientation and the inclination angle of the bit shaft 212 against the drill collar 202 can be controlled by the orientation control module 206.

Figure 3:
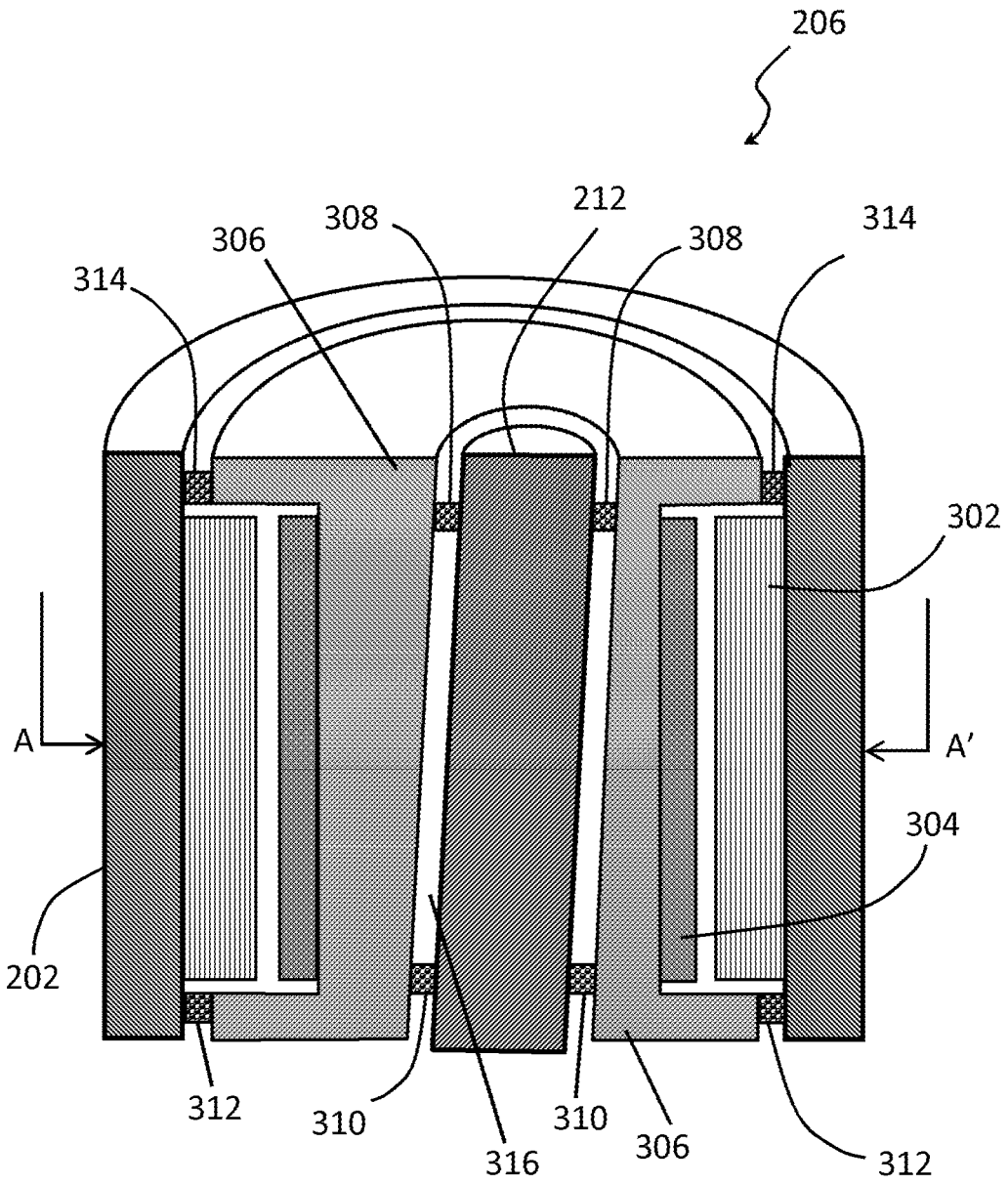
FIG. 3 illustrates an enlarged view of an orientation control module within the rotary steerable drilling tool shown in the FIG. 2.

FIG. 3 illustrates an enlarged view of the orientation control module 206 within the rotary steerable drilling tool 200 shown in the FIG. 2 according to some embodiments of the present invention. The orientation control module 206 can include an array of electromagnets 302, an array of permanent magnets 304, a rotor 306, and a set of bearings 308, 310, 312, and 314. The rotor 306 can be a cylinder with a hole 316 through it for letting the bit shaft 212 be positioned inside. The axis of the hole 316 is not in parallel with the axis of the rotor 306 so that the drill bit can be made to point to a desired direction. The orientation control module 206 can be coupled to the bit shaft 212 through the rotor 306. One side of the rotor 306 can be coupled to the bit shaft 212 through the bearings 308 and 310 and the other side of the rotor 306 can be coupled to the drill collar 202 through the bearings 312 and 314, so that the rotor 306 can rotate with respect to both the drill collar 202 and the bit shaft 212. The rotation of the rotor 306 then can force the bit shaft 212 to rotate about the universal joint accordingly. The movement of the rotor 306 can be driven by the interaction between the array of electromagnets 302 and the array of permanent magnets 304. The electromagnetic steering system, including the array of electromagnets 302 and the array of permanent magnets 304, can control the position and rotation speed of the rotor 306 to eventually steer the drilling direction of the wellbore.

In some embodiments, the rotor 306 can be made of high magnetic permeability metal to facilitate the magnetic flux passing through.

In some embodiments, the arrays of the electromagnets 302 can be coils.

Figure 4A:
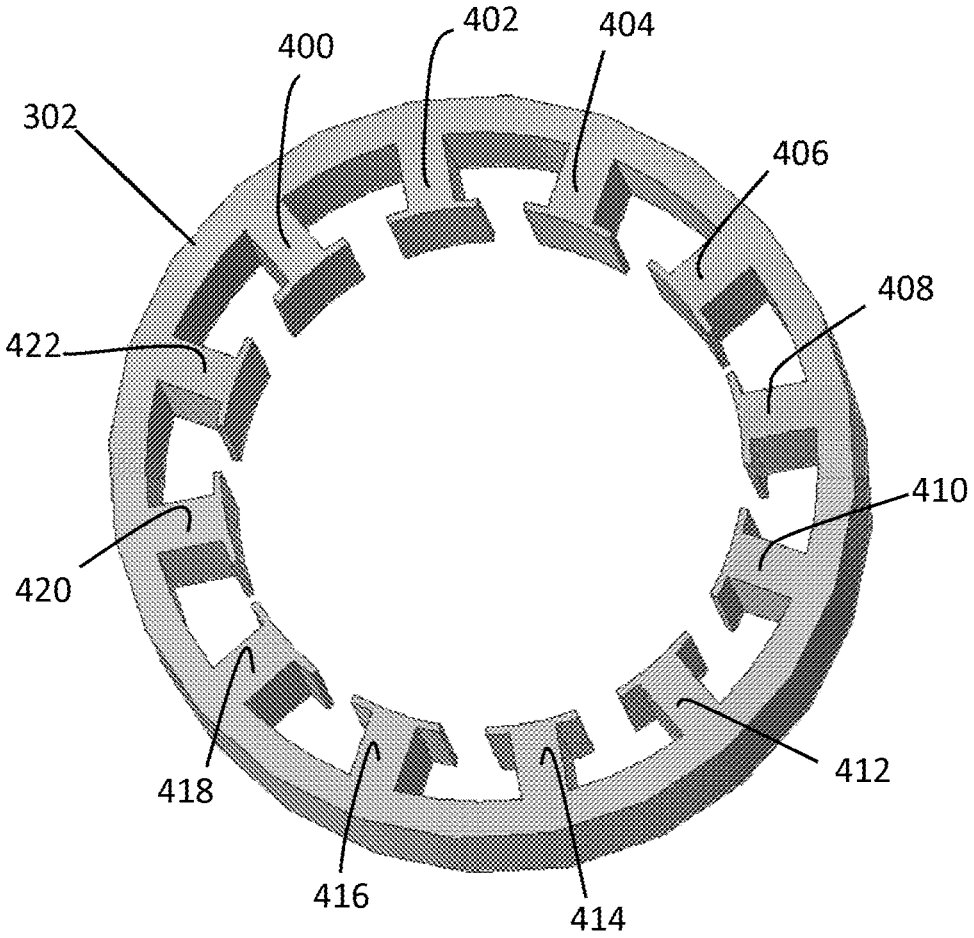
FIG. 4A illustrates a 3-D structure of a twelve-pole array of electromagnets.

FIG. 4A illustrates a 3-D structure of a twelve-pole array of electromagnets 302 according to some embodiments of the present invention. The array of electromagnets includes twelve poles 400, 402, 404, 406, 408, 410, 412, 414, 416, 418, 420, and 422. The number of the electromagnets (poles) can vary, preferably from three to twenty-four or even more, and be determined by the required rotation speed and torque of the rotor.

Figure 4B:
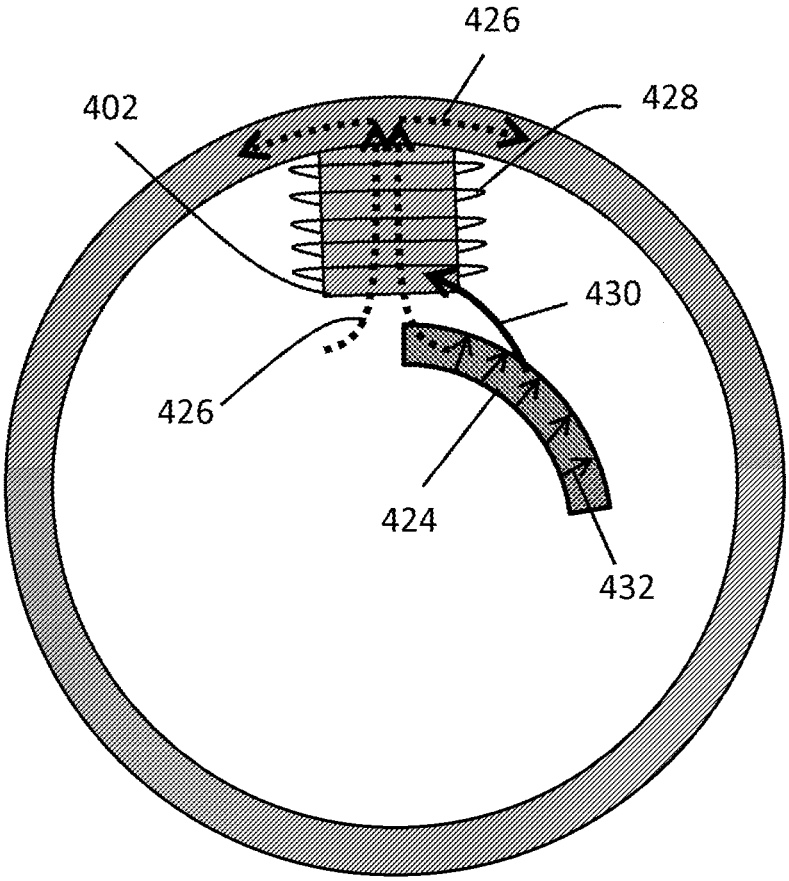
FIG. 4B illustrates a top view of a pole and a permanent magnet.

FIG. 4B illustrates a top view of a pole 402 and a permanent magnet 424 according to some embodiments of the present invention. The permanent magnet 424 can be magnetized in any orientation. In FIG. 4B, the permanent magnet 424 is magnetized in the direction 432 for an example. The pole 402 can be wound with wires 428 in either clockwise or counter-clockwise direction. When the pole 402 is wound with wires 428 in clockwise direction and applied with positive voltage signals, out-going magnetic flux 426 can be generated. If negative voltage signals are applied to the wires 428, the direction of the magnetic flux 426 would be reversed.

According to the law of electromagnetism, magnets with opposite poles should attract each other and magnets with like poles should repel each other. The pole 402 can exert a pulling force 430 to the nearby permanent magnet 424 and move the permanent magnet 424 along the direction 430. In operation, multiple electromagnets (poles) as shown in the FIG. 4A can interact with the permanent magnets at the same time to generate enough force to rotate the rotor 306 in the FIG. 3 to control the drilling direction of wells.

Figure 5:
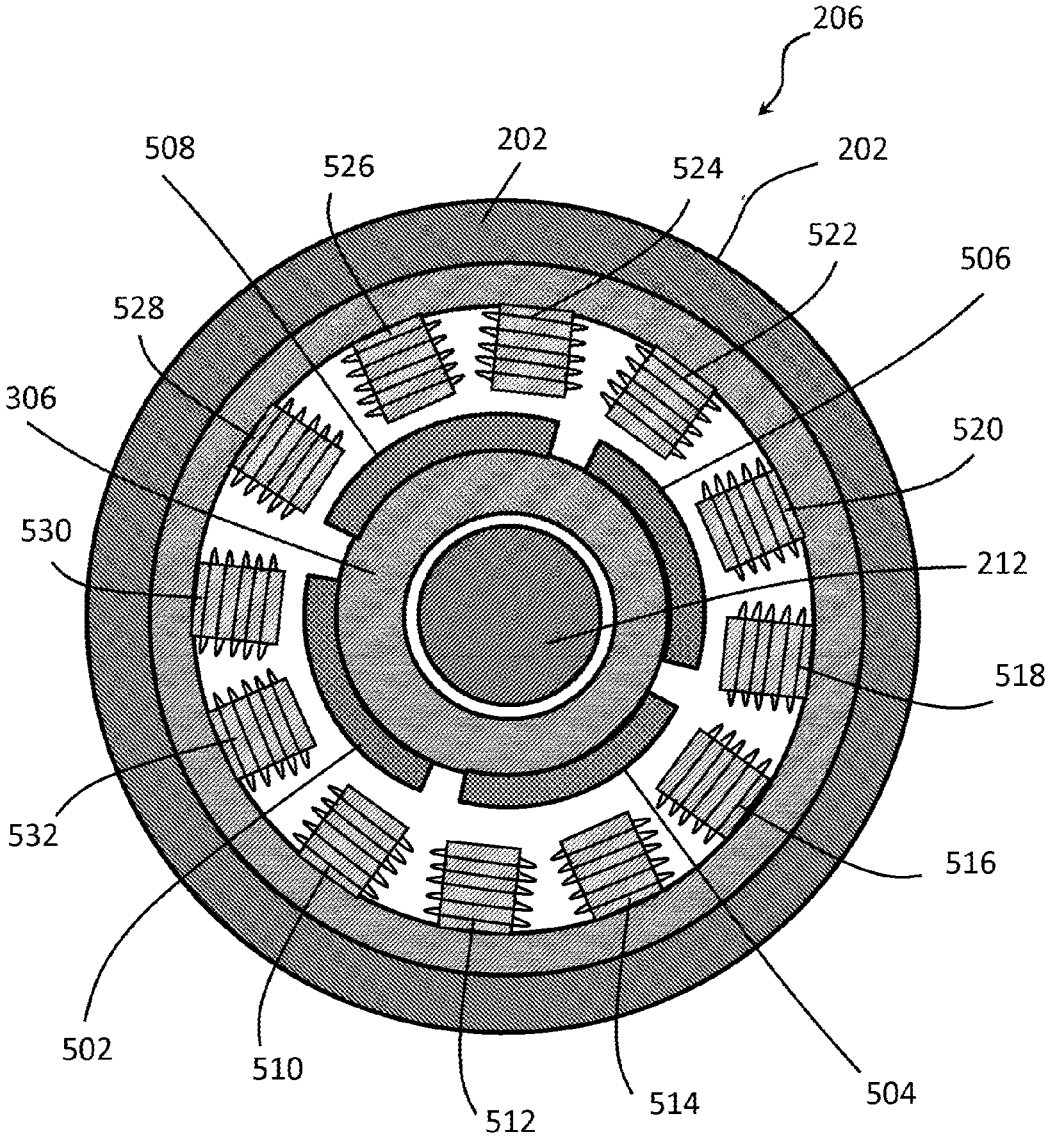
FIG. 5 illustrates a cross-sectional view of the control module along the line AA' in the FIG. 3.

FIG. 5 illustrates a cross-sectional view of the control module 206 along the line AA' in the FIG. 3. The control module 206 shown in the FIG. 5 can be deployed with four permanent magnets 502, 504, 506, and 508 on the rotor 306 and twelve electromagnets (poles) 510, 512, 514, 516, 518, 520, 522, 524, 526, 528, 530, and 532 on the drill collar 202. The polarization of the permanent magnets 502, 504, 506, and 508 can be alternate along the rotor 306, for example, while the permanent magnets 504 and 508 are having their north poles pointing radially outward, the permanent magnets 502 and 506 are having their north poles pointing radially inward.

To initiate the rotation of the rotor 306 in counter-clockwise direction, the electromagnetic pole 528 can be applied with positive voltage signals to generate pulling force to the permanent magnets 508 and pushing force to the permanent magnet 502; the electromagnetic pole 524 can be applied with negative voltage signals to generate pushing force to the permanent magnet 508 and pulling force to the permanent magnet 506; the electromagnetic pole 522 can be applied with negative voltage signals to generate pushing force to the permanent magnet 508 and pulling force to the permanent magnet 506; the electromagnetic pole 518 can be applied with positive voltage signals to generate pulling force to the permanent magnets 504 and pushing force to the permanent magnet 506; the electromagnetic pole 516 can be applied with positive voltage signals to generate pulling force to the permanent magnets 504 and pushing force to the permanent magnet 506; the electromagnetic pole 512 can be applied with negative voltage signals to generate pushing force to the permanent magnet 504 and pulling force to the permanent magnet 502; the electromagnetic pole 510 can be applied with negative voltage signals to generate pushing force to the permanent magnet 504 and pulling force to the permanent magnet 502; and the electromagnetic pole 530 can be applied with positive voltage signals to generate pulling force to the permanent magnets 508 and pushing force to the permanent magnet 502. However, the electromagnetic poles 514, 520, 526, and 532 have no effects on the permanent magnets 502, 504, 506, and 508 in the rotation status shown in the FIG. 5.

Figure 6A:
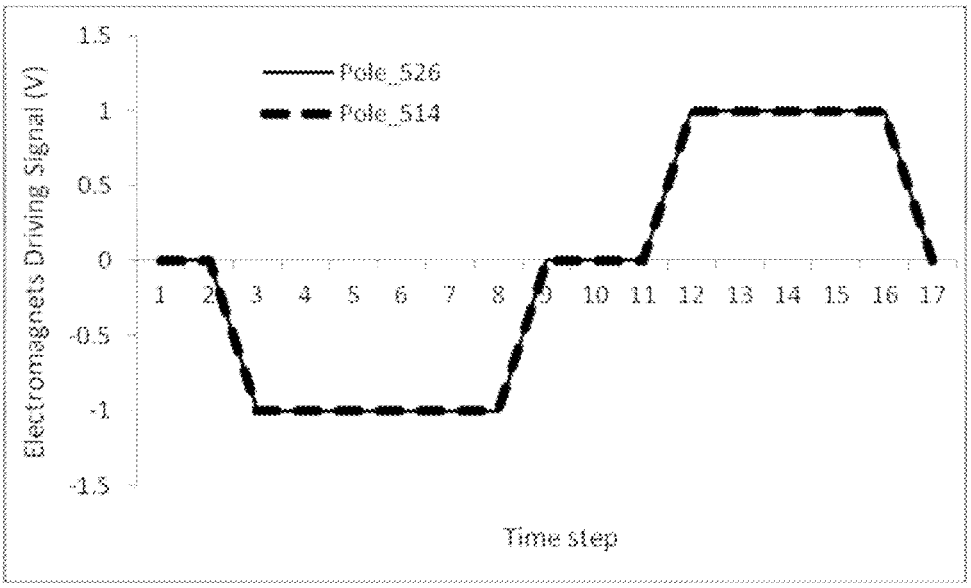
FIGS. 6A~6F illustrate diagrams of electromagnets driving signal (control voltage signal) versus time step for the electromagnetic poles.
Figure 6B:
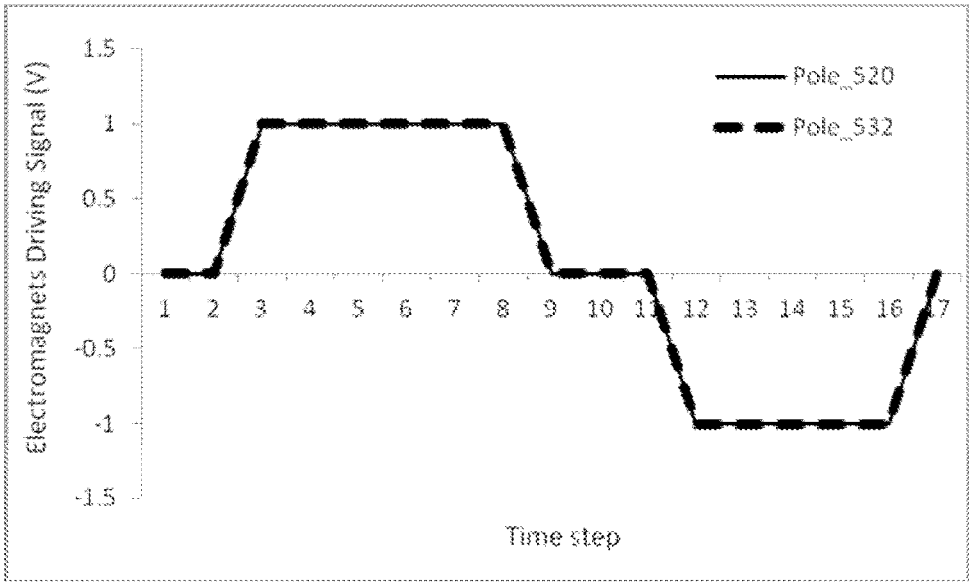
Figure 6C:
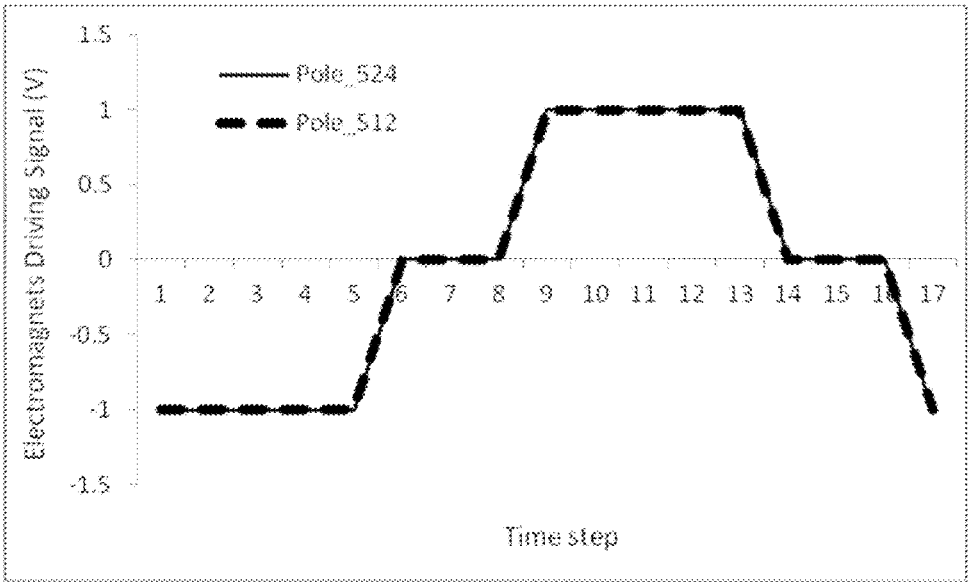
Figure 6D:
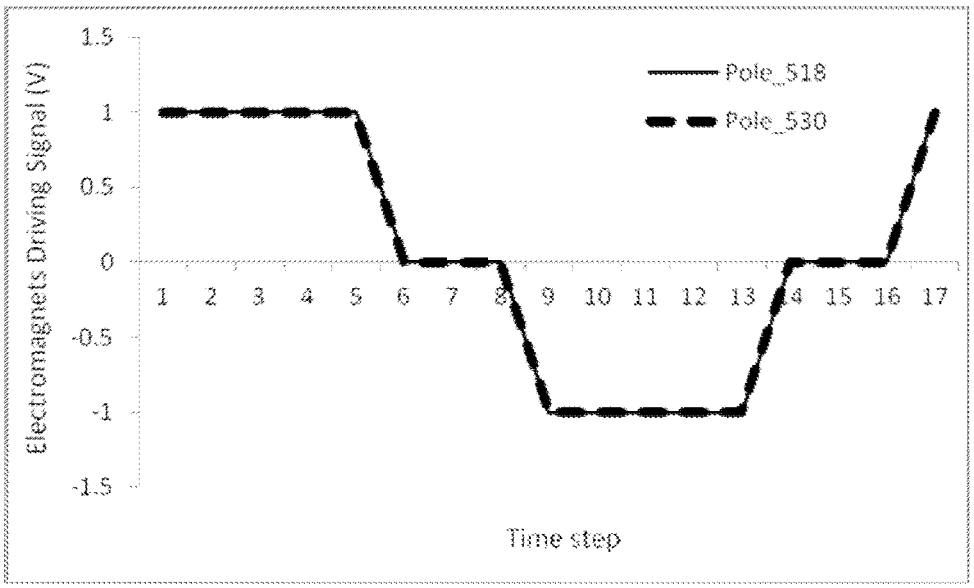
Figure 6E:
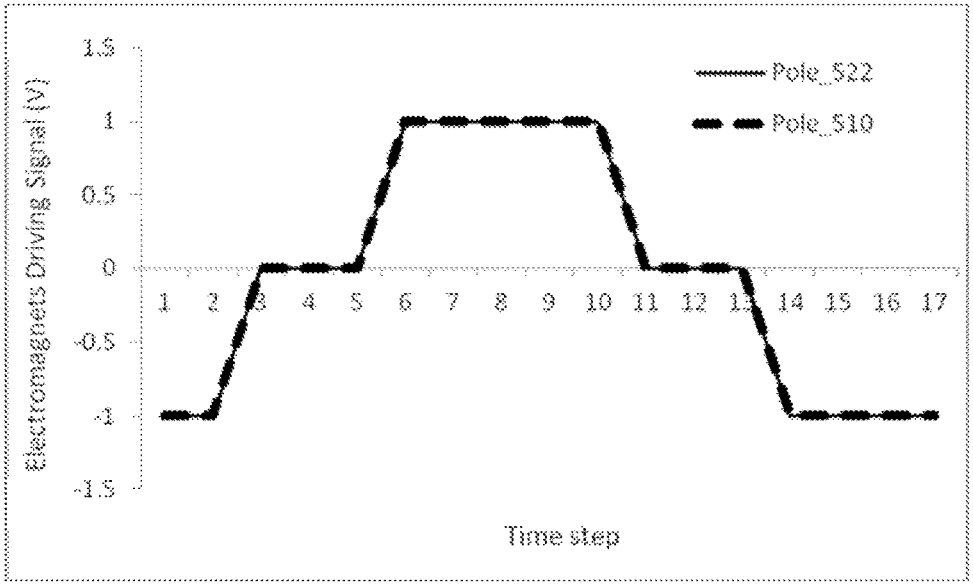
Figure 6F:
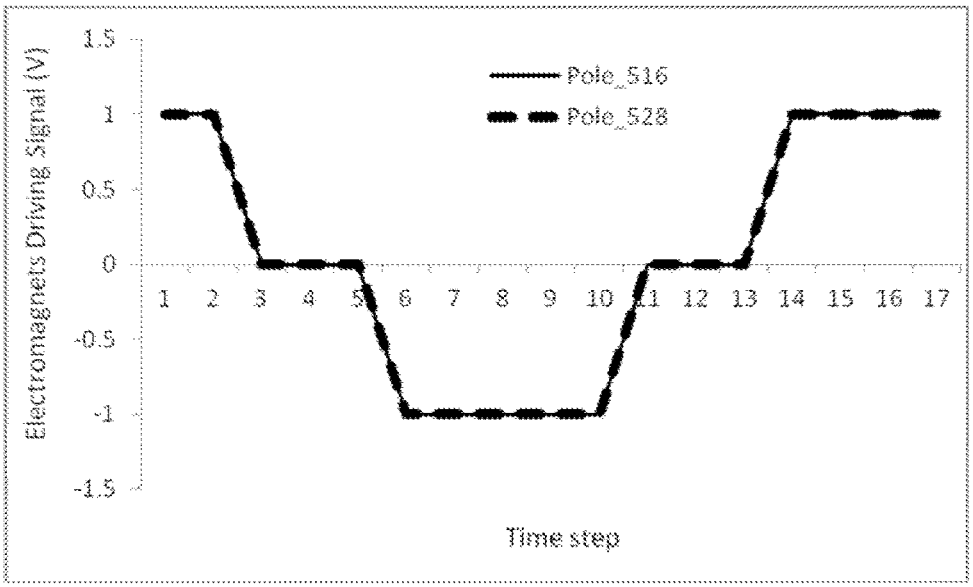

FIG. 6A illustrates a diagram of electromagnets driving signal (control voltage signal) versus time step for the electromagnetic poles 526 and 514. FIG. 6B illustrates a diagram of electromagnets driving signal (control voltage signal) versus time step for the electromagnetic poles 520 and 532. FIG. 6C illustrates a diagram of electromagnets driving signal (control voltage signal) versus time step for the electromagnetic poles 524 and 512. FIG. 6D illustrates a diagram of electromagnets driving signal (control voltage signal) versus time step for the electromagnetic poles 518 and 530. FIG. 6E illustrates a diagram of electromagnets driving signal (control voltage signal) versus time step for the electromagnetic poles 522 and 510. FIG. 6F illustrates a diagram of electromagnets driving signal (control voltage signal) versus time step for the electromagnetic poles 516 and 528.

It can be observed that the control voltage signals in FIGS. 6A and 6B have the same amplitudes but opposite polarization, as well as the FIGS. 6C and 6D and the FIGS. 6E and 6F.

In operation, the twelve electromagnetic poles can be divided into three groups: 1) the first group: electromagnetic poles 514, 526, 520, and 532; 2) the second group: electromagnetic poles 512, 524, 518, and 530; and 3) the third group: electromagnetic poles 510, 522, 516, and 528. The deployment of electromagnetic poles in each group can be alternate, for example, the electromagnetic poles 514 and 526 in the first group can be wound with wires in clockwise direction and the electromagnetic poles 520 and 532 in the same group can be wound with wires in counter clockwise direction.

In some embodiments, different control voltage signals can be applied to different groups to rotate the rotor 306 shown in the FIGS. 3 and 5. The rotation speed of the rotor 306 can be determined by the frequency of the control voltage signals. The rotation direction of the rotor 306 can be determined by the polarization of the control voltage signals.

The present invention is in no way limited to any particular number and type of the electromagnets and permanent magnets.

The present invention has been described in terms of specific embodiments incorporating details to facilitate the understanding of principles of construction and operation of the invention. It will be readily apparent to one skilled in the art that other various modifications may be made in the embodiment chosen for illustration without departing from the spirit and scope of the invention as defined by the claims.

What is claimed is:

1. An orientation control module comprising:

an elongated cylindrically-shaped hollow housing;

a rotor substantially having a body shape of an axially elongated cylinder having a hollow interior portion, rotatably disposed within said hollow housing, said rotor further having an upper portion with an open end, and lower portion with an open end, said hollow interior portion allowing a bit shaft to be positioned inside said rotor;

a plurality of bearings contactibly disposed between an inner surface of said hollow housing and an outer surface along the circumferences of the upper portion and lower portion of said rotor;

a second plurality of bearings contactibly disposed between an inner surface of said rotor, and an outer surface of said bit shaft disposed within said rotor;

a plurality of electromagnets disposed on an inner surface of said hollow housing; and, a plurality of permanent magnets disposed on an outer surface of said rotor.

2. The orientation control module of claim 1 wherein the axis of the hollow portion of the rotor is not parallel to the axis of the rotor.

3. The orientation control module of claim 1 wherein the electromagnets are comprised of coils mounted on a multi-pole metal core.

4. The orientation control module of claim 3 wherein said multi-pole metal core is further comprised of a material with a high magnetic permeability.

5. The orientation control module of claim 1 wherein the number of electromagnets is at least twelve and the number of permanent magnets is at least four.

6. An orientation control module comprising:

an elongated cylindrically-shaped hollow housing;

a rotor made of metal substantially having a body shape of an axially elongated cylinder having a hollow interior portion, rotatably disposed within said hollow housing, wherein the axis of the hollow interior portion of the rotor is not parallel to the axis of the rotor;

said rotor having an upper portion and lower portion, said hollow interior portion allowing a bit shaft to be positioned inside said rotor;

a plurality of bearings contactibly disposed between an inner surface of said hollow housing and an outer surface along the circumferences of the upper portion and lower portion of said rotor;

a second plurality of bearings contactibly disposed between an inner surface of said rotor, and an outer surface of said bit shaft disposed within said rotor;

an array of at least twelve electromagnets disposed at predetermined intervals along an inner surface of said hollow housing, and, an array of at least four permanent magnets disposed along an outer surface of said rotor.

7. The orientation control module of claim 6 wherein the electromagnets are comprised of coils mounted on a multi-pole metal core.

8. The orientation control module of claim 6 wherein the electromagnets are comprised of coils mounted on a multi-pole metal core, said multi-pole metal core being further comprised of a material with high magnetic permeability.

* * * * *